US009356401B1

(12) United States Patent
Horning et al.

(10) Patent No.: US 9,356,401 B1
(45) Date of Patent: May 31, 2016

(54) ELECTRICAL CONNECTOR WITH GROUND FRAME

(71) Applicants: Tyco Electronics Corporation, Berwyn, PA (US); Tyco Electronics (Shanghai) Co., Ltd., Shanghai (CN)

(72) Inventors: Michael James Horning, Lancaster, PA (US); Wayne Davis, Harrisburg, PA (US); Chad Morgan, Carneys Point, NJ (US); Peter Cherok, Dillsburg, PA (US); Liang Huang, Chengdu (CN)

(73) Assignees: Tyco Electronics Corporation, Berwyn, PA (US); Tyco Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 14/591,998

(22) Filed: Jan. 8, 2015

(30) Foreign Application Priority Data

Dec. 25, 2014 (CN) ..... 2014 1 0822636

(51) Int. Cl.
*H01R 13/6585* (2011.01)
*H01R 12/73* (2011.01)

(52) U.S. Cl.
CPC ..... *H01R 13/6585* (2013.01); *H01R 12/73* (2013.01)

(58) Field of Classification Search
CPC ..... H01R 13/4223; H01R 13/6585
USPC ..... 439/58, 595, 607.11, 607.18, 607.12, 439/74, 78
See application file for complete search history.

(56) References Cited

U.S. PATENT DOCUMENTS

| | | | | |
|---|---|---|---|---|
| 6,106,340 | A * | 8/2000 | Myer | H01R 13/4367 439/595 |
| 8,002,581 | B1 * | 8/2011 | Whiteman, Jr. | H01R 12/724 439/607.18 |
| 8,469,745 | B2 * | 6/2013 | Davis | H01R 12/724 439/607.07 |
| 8,905,786 | B2 * | 12/2014 | Davis | H01R 13/6587 439/108 |
| 2013/0178107 | A1 * | 7/2013 | Costello | H01R 13/6585 439/628 |
| 2013/0217263 | A1 * | 8/2013 | Pan | H01R 13/6474 439/607.07 |
| 2013/0237091 | A1 * | 9/2013 | Mason | H01R 13/6585 439/607.05 |
| 2014/0017950 | A1 * | 1/2014 | Peloza | H01R 12/73 439/629 |

* cited by examiner

*Primary Examiner* — Tulsidas C Patel
*Assistant Examiner* — Marcus Harcum

(57) ABSTRACT

An electrical connector includes a housing, contacts, ground shields, and a ground frame. The housing extends between a front end and an opposite rear end. The front end is configured to be mated with a mating connector. The contacts and ground shields are held by the housing. The ground shields at least partially surround the contacts to provide electrical shielding for the contacts. The ground frame has a first side coupled to the rear end of the housing and a second side facing the circuit board. The contacts have terminating ends and the ground shields have mounting ends. The terminating ends and the mounting ends extend from the rear end of the housing through the ground frame for termination to the circuit board. The ground frame engages the ground shields to electrically join the ground shields.

20 Claims, 8 Drawing Sheets

ELECTRICAL CONNECTOR WITH GROUND FRAME

BACKGROUND OF THE INVENTION

The subject matter herein relates generally to electrical connectors that have an array of signal contacts and associated ground shields.

Some known electrical connectors are mezzanine connectors that mechanically and electrically interconnect a pair of circuit boards in a parallel arrangement. In some connector arrangements, a single mezzanine connector will engage both circuit boards to interconnect the circuit boards. For example, the mezzanine connector will be mounted to one of the circuit boards and will engage the other circuit board at a separable mating interface. At least some known mezzanine connector systems utilize two mezzanine connectors that are each mounted to a different circuit board and then mated together. Such systems can be complex and difficult to manufacture. For example, such mezzanine connectors have many contacts individually loaded into a housing, which may be difficult and time consuming to assemble. Furthermore, the contacts may be deflectable spring beams that require long beam lengths to achieve the required spring force and deformation range at the mating interface between the two connectors. The mezzanine connectors have ground shields that are designed to shield individual contacts or contact pairs along the beam length. But, known mezzanine connectors suffer from signal performance limits because the ground shields are not electrically commoned with each other along the length of the connectors. For example, the ground shields may be electrically commoned at the circuit boards, but a lack of commoning along the beam lengths and at the mating interface results in electrical interference that is detrimental to the signal integrity of the mezzanine connectors.

Thus, a need exists for an electrical connector having an array of signal contacts and enhanced ground shielding that improves electrical performance.

BRIEF DESCRIPTION OF THE INVENTION

In one embodiment, an electrical connector is provided that includes a housing, contacts, ground shields, and a ground frame. The housing extends between a front end and an opposite rear end. The front end is configured to be mated with a mating connector. The contacts are held by the housing. The contacts have terminating ends extending from the rear end of the housing for termination to a circuit board. The ground shields are held by the housing. The ground shields at least partially surround the contacts to provide electrical shielding for the contacts. The ground shields having mounting ends extending from the rear end of the housing for termination to the circuit board. The ground frame has a first side coupled to the rear end of the housing and a second side facing the circuit board. The ground frame defines openings between the first side and the second side. The terminating ends of the contacts and the mounting ends of the ground shields extend through the openings for termination to the circuit board. The ground frame engages the ground shields to electrically join the ground shields.

In another embodiment, an electrical connector is provided that includes a housing, a ground frame, contacts, and ground shields. The housing extends between a front end and an opposite rear end. The front end is configured to be mated with a mating connector. The housing defines plural cavities that extend between the front end and the rear end. The housing includes deflectable retention latches within the cavities. The ground frame has a first side coupled to the rear end of the housing and a second side facing a circuit board. The contacts are held by the housing. The contacts have terminating ends extending from the rear end of the housing through the ground frame for termination to the circuit board. The contacts are organized in plural contact pairs. Each contact pair is disposed in one of the cavities of the housing. The ground shields are held by the housing. Each ground shield at least partially surrounds one of the contact pairs to provide electrical shielding between said contact pair and nearby contact pairs. The ground shields have mounting ends extending from the rear end of the housing through the ground frame for termination to the circuit board. The ground shields engage the ground frame to electrically join the ground shields. Each retention latch has a first tab configured to retain the ground shield in the respective cavity and a second tab configured to retain the contact pair in the respective cavity.

DETAILED DESCRIPTION OF THE INVENTION

Figure 1:
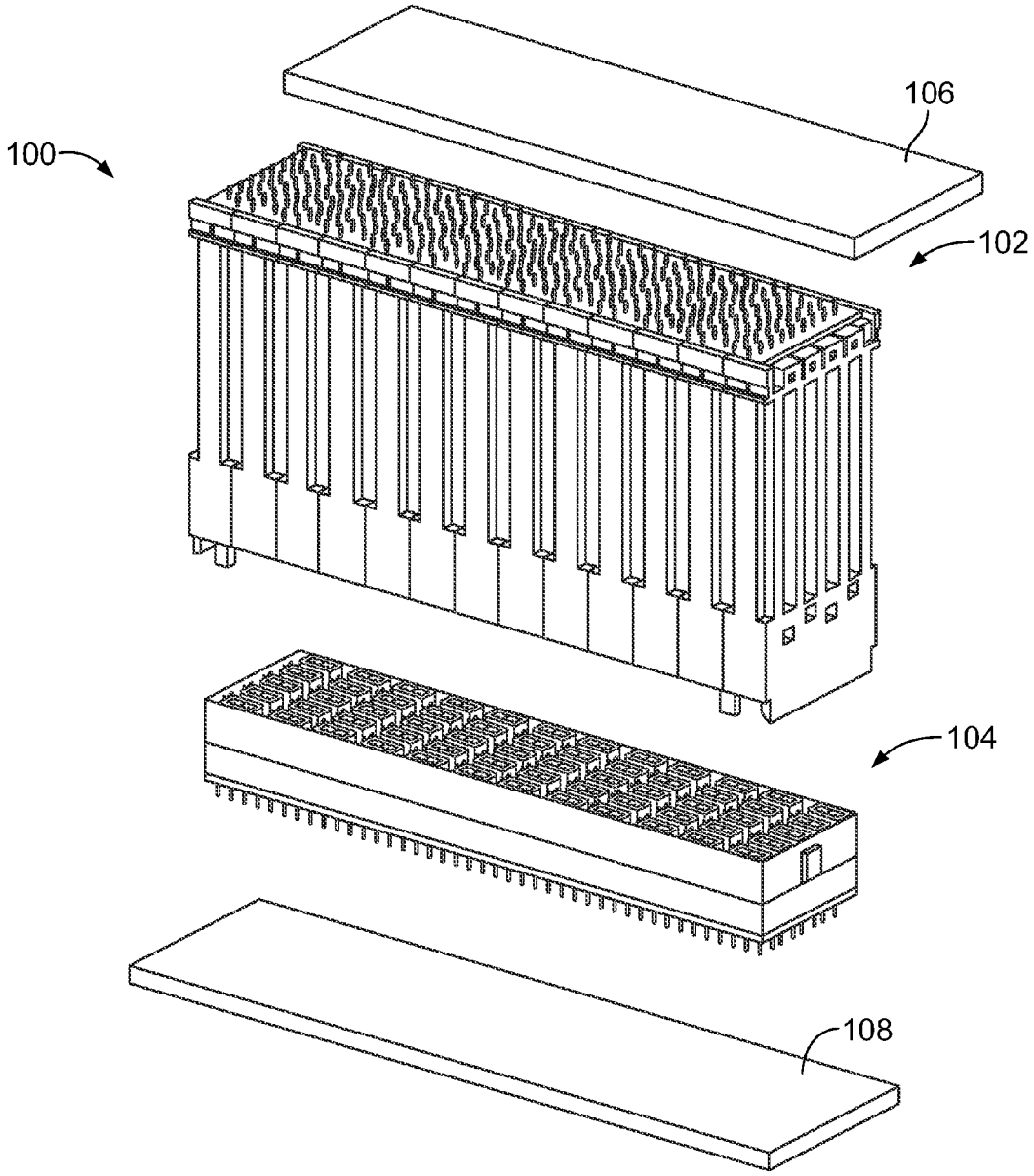
FIG. 1 illustrates a connector assembly formed in accordance with an embodiment.

FIG. 1 illustrates a connector assembly 100 formed in accordance with an embodiment. The connector assembly 100 includes a first electrical connector 102 and a second electrical connector 104 that are mated together to electrically connect first and second circuit boards 106, 108. The first electrical connector 102 and the second electrical connector 104 are arranged to interconnect the first and second circuit boards 106, 108. The first connector 102 and the second connector 104 may be mezzanine connectors that connect the circuit boards 106, 108 in a parallel arrangement. However, it is realized that the subject matter herein may be used in other types of electrical connectors as well, such as right angle connectors, cable connectors (being terminated to an end of one of more cables), or other types of electrical connectors. In an embodiment, the first electrical connector 102 is a header connector 102 and the second electrical connector 104 is a receptacle connector 104. The terms "header connector 102" and "receptacle connector 104" are used herein to identify the first electrical connector 102 and the second electrical connector 104, respectively. The header connector 102 and the receptacle connector 104 may also be referred to herein as "mezzanine header connector 102" and "mezzanine receptacle connector 104," respectively.

The circuit boards 106, 108 are interconnected by the header and receptacle connectors 102, 104 so that the circuit boards 106, 108 are substantially parallel to one another. The first and second circuit boards 106, 108 include conductors that communicate data signals and/or electric power between the header and receptacle connectors 102, 104 and one or more electrical components (not shown) that are electrically connected to the circuit boards 106, 108. The conductors may be embodied in conductive pads or traces deposited on one or more layers of the circuit boards 106, 108, in plated vias, or in other conductive pathways, contacts, and the like.

Figure 2:
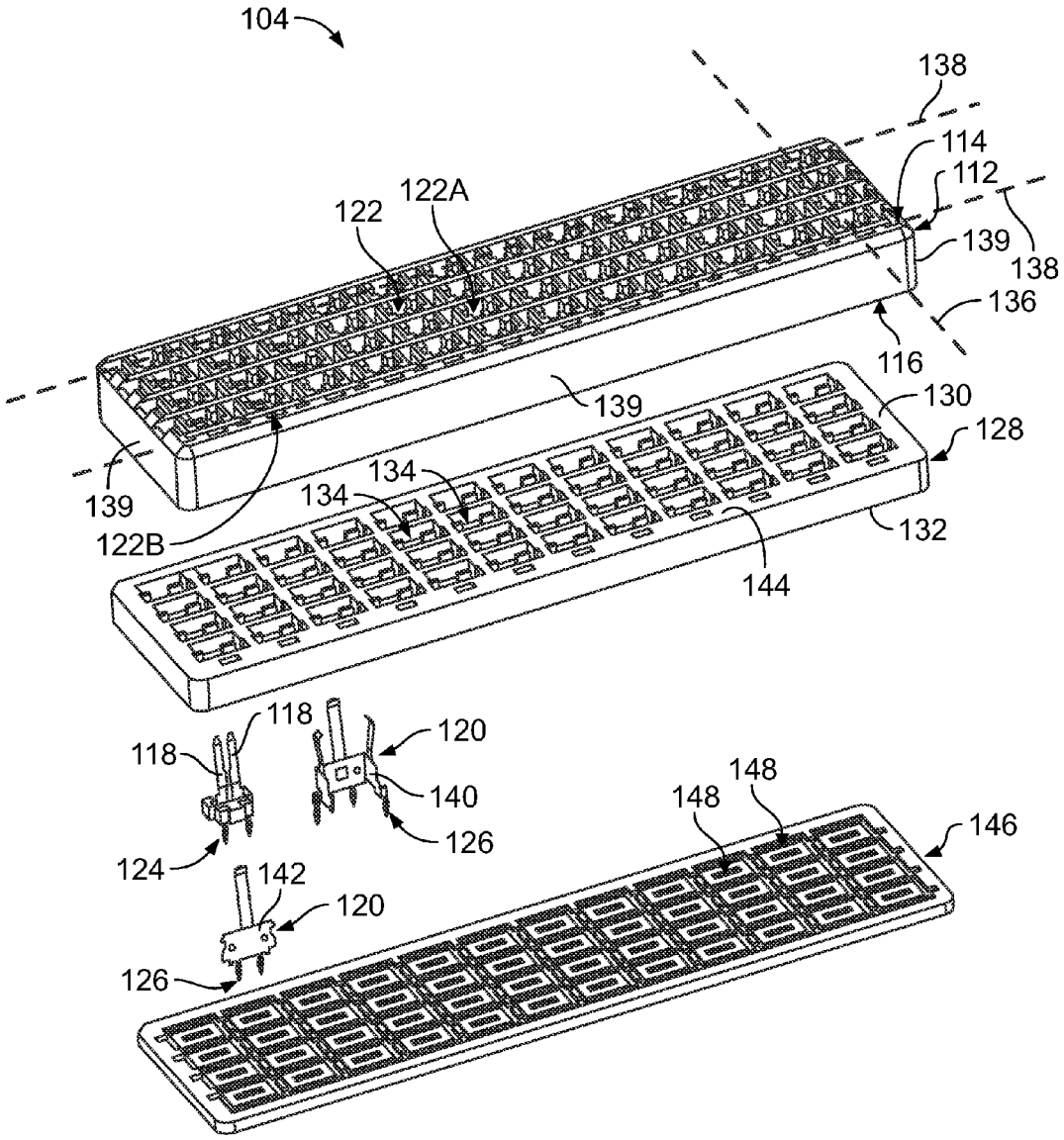
FIG. 2 is an exploded view of a receptacle connector of the connector assembly in accordance with an embodiment.

FIG. 2 is an exploded view of the mezzanine receptacle connector 104 in accordance with an embodiment. The mezzanine receptacle connector 104 includes a housing 112 extending between a front end 114 and an opposite, rear end 116. As used herein, relative or spatial terms such as "top," "bottom," "left," "right," "front," and "rear" are only used to distinguish the referenced elements and do not necessarily require particular positions or orientations in the mezzanine connector assembly 100 (shown in FIG. 1), in the mezzanine receptacle connector 104 specifically, or in the surrounding environment. The front end 114 is configured to be mated with the mezzanine header connector 102 (shown in FIG. 1). The rear end 116 is configured to face the second circuit board 108 (shown in FIG. 1). The housing 112 includes sides 139 that define a perimeter of the housing 112 between the front end 114 and the rear end 116. Optionally, the housing 112 may be generally box shaped, however the housing 112 may have any shape in alternative embodiments. The housing 112 holds a plurality of receptacle contacts 118 that extend between the front end 114 and the rear end 116. The receptacle contacts 118 may be referred to herein as contacts 118. In an embodiment, the housing 112 includes cavities 122 extending between the front end 114 and the rear end 116. The cavities are arranged in columns 136 and rows 138. The contacts 118 are received in the cavities 122. The housing 112 is an electrical insulator that is manufactured from at least one dielectric material, such as a plastic material.

The contacts 118 have terminating ends 124 configured to terminate to the second circuit board 108 (shown in FIG. 1). When the contacts 118 are loaded in the cavities 122 of the housing 112, the terminating ends 124 extend from the rear end 116. The contacts 118 may be loaded into cavities 122 through the rear end 116 of the housing 112. In an embodiment, the contacts 118 are arranged in pairs that carry differential signals. In alternative embodiments, the contacts 118 may carry single-ended signals rather than differential signals. In other alternative embodiments, the contacts 118 may carry power rather than data signals.

The mezzanine receptacle connector 104 also includes a plurality of receptacle ground shields 120 held in the housing 112. The receptacle ground shields 120 are referred to herein as ground shields 120. The ground shields 120 at least partially surround the contacts 118 to provide electrical shielding for the contacts 118. For example, the ground shields 120 may provide shielding for each pair of the contacts 118 from adjacent or nearby pairs of contacts 118. In an embodiment, the ground shields 120 are arranged to provide shielding around multiple sides of each pair of contacts 118. For example, the ground shields 120 include C-shields 140 extending along three sides of a corresponding pair of contacts 118. The ground shields 120 also include orphan shields 142 extending along one side of a corresponding pair of contacts 118. In alternative embodiments, the ground shields 120 may be planar, and may be arranged in lateral rows and longitudinal columns to provide shielding between the contacts 118 or pairs of the contacts 118.

The ground shields 120 are loaded in the cavities 122 of the housing 112. Some ground shields 120 may be loaded into the same cavity 122 as the pair of contacts 118 that the respective ground shields 120 surround. For example, at least some of the cavities 122 include one pair of contacts 118 and one ground shield 120 therein. In an embodiment, the housing 112 defines main cavities 122A and auxiliary cavities 122B. The main cavities 122A each include one pair of contacts 118 and one C-shield 140. The auxiliary cavities 122B each include one orphan shield 142. In an alternative embodiment, the orphan shields 142 are received in common cavities as the contacts 118 and the C-shields 140. The auxiliary cavities 122B are arranged in one row 138 in the illustrated embodiment. The ground shields 120 may be inserted into the housing 112 through the rear end 116 of the housing 112. The ground shields 120 have mounting ends 126 configured to terminate to the second circuit board 108 (shown in FIG. 1). When the ground shields 120 are loaded in the cavities 122 of the housing 112, the ground shields 120 are arranged in columns and rows according to the columns 136 and rows 138 of the cavities 122. The mounting ends 126 of the ground shields 120 extend from the rear end 116. The ground shields 120 may be configured to electrically connect to one or more conductive, grounded surfaces of the mezzanine header connector 102 (shown in FIG. 1) and/or the circuit board 108.

The mezzanine receptacle connector 104 further includes a ground frame 128 that has a first side 130 and an opposite, second side 132. The first side 130 couples to the rear end 116 of the housing 112. The ground frame 128 couples to the housing 112 via one or more fasteners, adhesives, latches, or the like. The second side 132 faces the second circuit board 108 (shown in FIG. 1). The terminating ends 124 of the contacts 118 and the mounting ends 126 of the ground shields 120 extend through the ground frame 128 for termination to the circuit board 108. For example, the ground frame 128 defines openings 134 that extend between the first side 130 and the second side 132. The openings 134 align with the cavities 122 of the housing 112. The terminating ends 124 and the mounting ends 126 extend from the housing 112 through the openings 134 to access and terminate to the circuit board 108.

In an exemplary embodiment, the ground frame 128 is an electrical conductor that is manufactured from at least one conductive material, such as metal. The ground frame 128 is configured to engage the ground shields 120 to electrically join or common the ground shields 120. For example, the ground frame 128 engages ground shields 120 that are disposed in different columns 136 and in different rows 138 of cavities 122 of the housing 112 to electrically common the ground shields 120 across the different columns 136 and across the different rows 138. The ground frame 128 electrically commons the ground shields 120 along a plane that is vertically between a separable mating interface, where the ground shields 120 engage conductive components of the mezzanine header connector 102, and a plane of the second circuit board 108 (shown in FIG. 1).

The mezzanine receptacle connector 104 includes a pin organizer 146. The pin organizer 146 is configured to be coupled to the second side 132 of the ground frame 128, extending between the ground frame 128 and the second circuit board 108 (shown in FIG. 1). The pin organizer 146 includes a plurality of apertures 148 therethrough that receive corresponding terminating ends 124 of the contacts 118 and/or mounting ends 126 of the ground shields 120. The pin organizer 146 holds the positions of the contacts 118 and/or the ground shields 120 relative to the circuit board 108 for termination to the circuit board 108. The pin organizer 146 may protect the terminating ends 124 of the contacts 118 and/or the mounting ends 126 of the ground shields 120 from damage, such as during shipping, assembly, and/or mounting to the second circuit board 108. The pin organizer 146 is an electrical insulator that is formed of a dielectric material, such as plastic. The pin organizer 146 electrically insulates the conductive ground frame 128 from conductors on the circuit board 108. In an alternative embodiment, the mezzanine receptacle connector 104 does not include the pin organizer 146, and the second side 132 of the ground frame 128 has a non-conductive layer or coating that electrically insulates the ground frame 128 from the circuit board 108.

Figure 8:
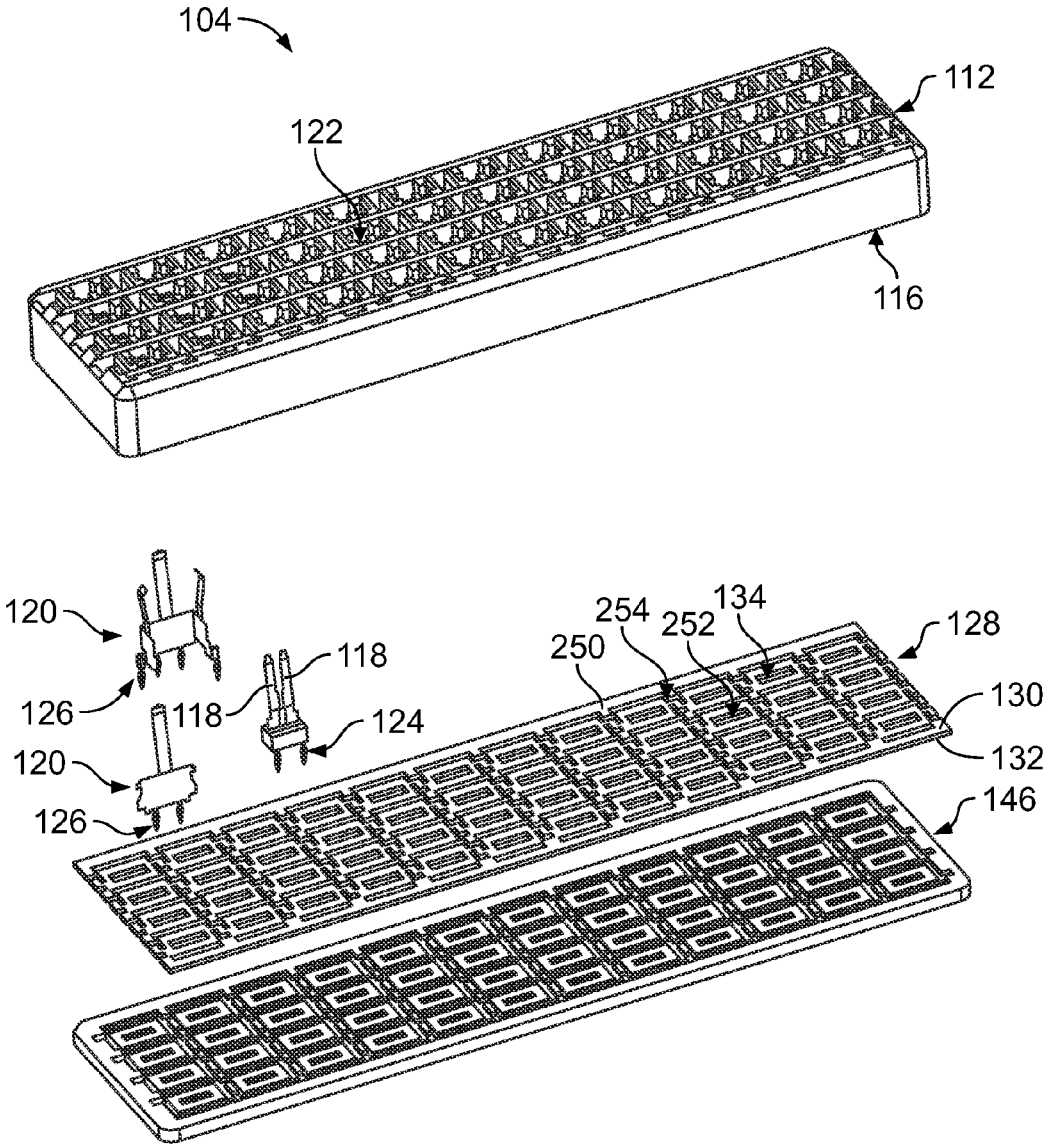
FIG. 8 is an exploded view of the receptacle connector in accordance with an alternative embodiment.

In the illustrated embodiment, the ground frame 128 is a ground housing 144. The ground housing 144 is formed by metal plating a plastic base or by a metal molding process, such as die-casting, injection molding, or the like. The ground housing 144 may be coupled to the rear end 116 of the housing 112 prior to the contacts 118 and the ground shields 120 being received in the cavities 122 of the housing 112. For example, the contacts 118 and the ground shields 120 may be loaded into the cavities 122 from the second side 132 of the ground housing 144 through the openings 134 in the ground housing 144. The openings 134 of the ground housing 144 may be the same or a similar size and shape as the cavities 122 of the housing 112. Alternatively, the contacts 118 and the ground shields 120 may be loaded into the cavities 122 of the housing 112 prior to coupling the ground housing 144 to the housing 112. The ground frame 128 may have other dimensions, materials, or the like in other embodiments. For example, in an alternative embodiment, the ground frame 128 may be a ground plate 250, as shown in FIG. 8.

Figure 3:
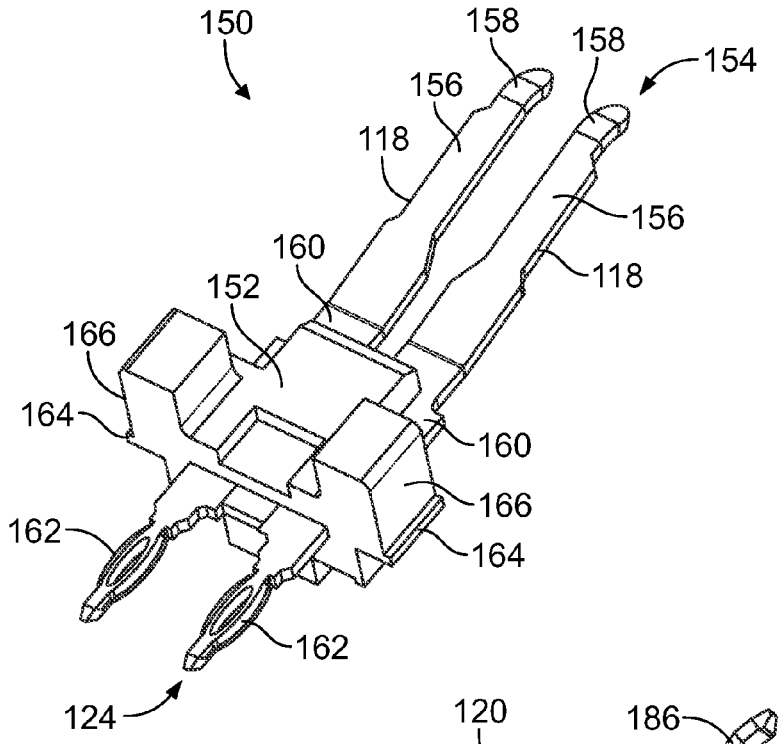
FIG. 3 is a perspective view of a contact pair of the receptacle connector according to an embodiment.

FIG. 3 is a perspective view of a contact pair 150 of the mezzanine receptacle connector 104 (shown in FIG. 1) according to an embodiment. The contact pair 150 is a pair of the receptacle contacts 118. The contact pair 150 includes an overmold body 152 that holds the pair of contacts 118. The contacts 118 are stamped and formed from a sheet of metal. The overmold body 152 is formed of a non-conductive dielectric material, such as a plastic. The overmold body 152 may encase a portion of the contacts 118 to fix the positions of the contacts 118 relative to each other and to the overmold body 152.

The contacts 118 in the contact pair 150 extend between the terminating end 124 and a mating end 154. Each contact 118 includes a spring beam 156 that extends from an intermediate segment 160 to the mating end 154. The spring beam 156 is deflectable and is configured to be mated with a corresponding header contact (not shown) of the mezzanine header connector 102 (shown in FIG. 1). The spring beam 156 includes a curved mating interface 158 proximate to the mating end 154. The mating interface 158 is configured engage the corresponding header contact. Optionally, the mating interface 158 may be hook shaped. The spring beam 156 may be elastically deformed and biased when mated to the header contact, such that the mating interface 158 presses against the header contact to maintain an electrical connection therewith.

The contacts 118 each include a compliant pin 162 that defines the terminating end 124. The compliant pin 162 is configured to be terminated to the second circuit board 108 (shown in FIG. 1). The compliant pins 162 may be eye-of-the-needle pins. The compliant pins 162 may be received in the apertures 148 (shown in FIG. 2) of the pin organizer 146 (FIG. 2) to access the circuit board 108. At the circuit board 108, the compliant pins 162 may be received in plated vias in the circuit board 108 to mechanically and electrically couple the contact pair 150 to the circuit board 108. Types of interfaces other than a compliant pin, such as a solder pin, a solder tail, a spring beam, and the like, may be provided at the terminating end 124 in alternative embodiments.

The overmold body 152 may surround or encase at least a portion of the intermediate segments 160 of the contacts 118. The overmold body 152 may be overmolded around the contacts 118 during a molding process that forms the body 152. Alternatively, the overmold body 152 may be formed and subsequently mounted around the contact pair 150. In an embodiment, the overmold body 152 includes at least one rib 164 that projects from a side 166 of the overmold body 152. The illustrated embodiment shows two ribs 164 located on opposite sides 166. The ribs 164 are configured to engage a surrounding ground shield 120 (shown in FIG. 2) to force the ground shield 120 outwards against the ground frame 128 (FIG. 2). In addition, interference between the ribs 164 and the ground shield 120 may support retention of the contact pair 150 and/or the ground shield 120 in the cavity 122 (shown in FIG. 2) of the housing 112 (FIG. 2).

Figure 4A:
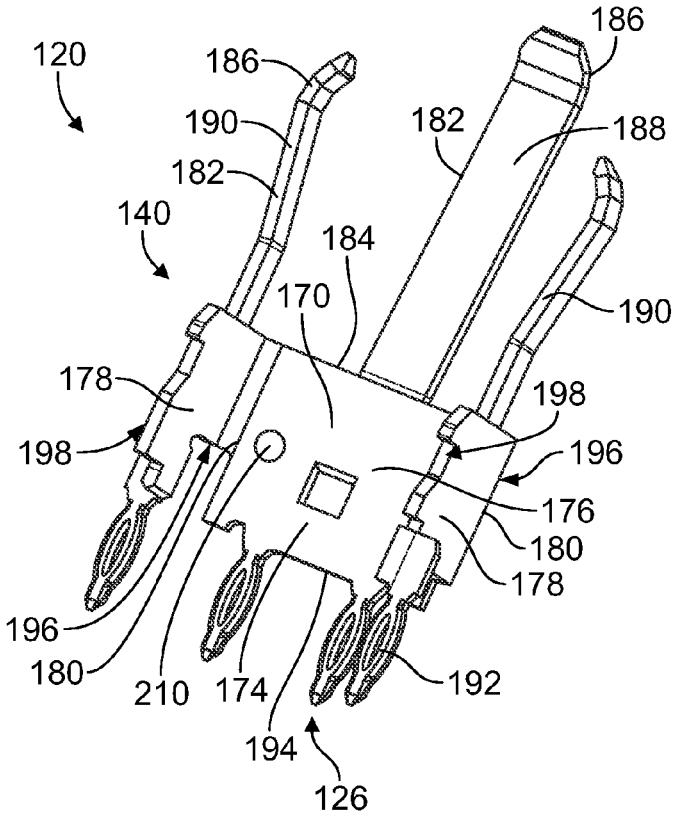
FIGS. 4A and 4B are perspective views of a C-shield type of ground shield according to an embodiment.
Figure 4B:
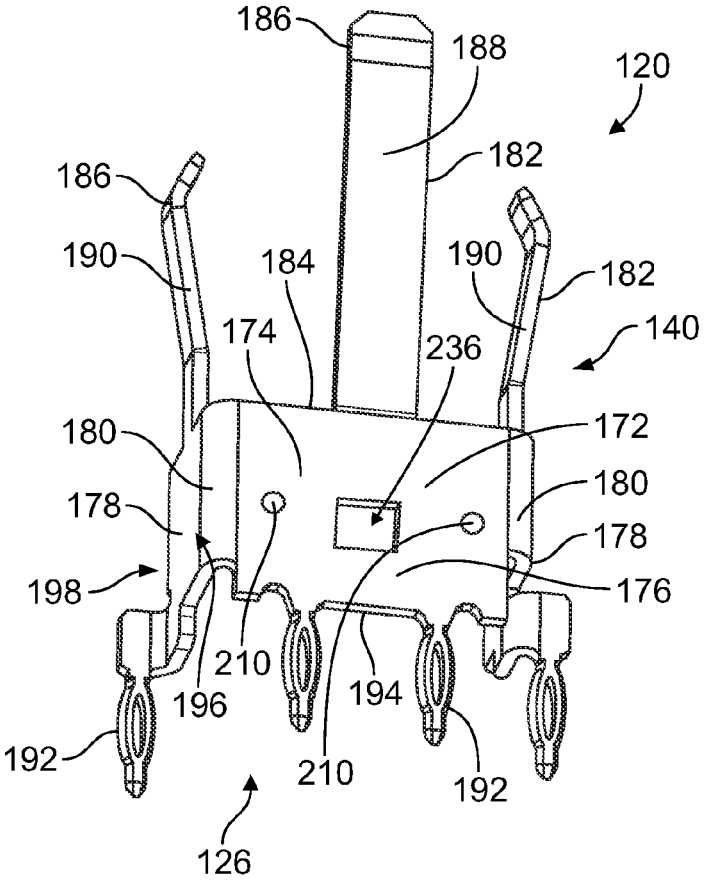

FIG. 4A is a perspective view of a C-shield 140 type of ground shield 120 according to an embodiment showing an interior surface 170 of the C-shield 140. FIG. 4B is a perspective view of the C-shield 140 type of ground shield 120 showing an exterior surface 172 of the C-shield 140. The C-shields 140 each include a base 174. The base 174 is configured to be plugged into the housing 112 (shown in FIG. 2) and/or the ground frame 128 (FIG. 2) during assembly of the mezzanine receptacle connector 104 (FIG. 1). The base 174 has a center wall 176 and two side walls 178 that extend from sides 180 of the center wall 176. The center wall 176 and the side walls 178 are generally planar (although are not coplanar with each other). The side walls 178 may extend parallel to each other in a common direction from the center wall 176. The C-shields 140 may be stamped and formed from a sheet of metal. For example, the center wall 176 is integral with the side walls 178, and the base 174 is formed by bending the side walls 178 out of plane from the center wall 176.

In an embodiment, the C-shields 140 include spring beams 182 that extend from a top 184 of the base 174. The spring beams 182 are deflectable and are configured to interface with corresponding header ground shields (not shown) of the mezzanine header connector 102 (shown in FIG. 1). The spring beams 182 may be bent and angled out of the plane(s) of the base 174. The spring beams 182 have curved tips 186 that may be used to guide mating with the header ground shields. Optionally, each base 174 may include three spring beams 182. For example, in the illustrated embodiment, a center beam 188 extends from the center wall 176 of the base 174, and a side beam 190 extends from each of the side walls 178. The center beams 188 and the side beams 190 may be configured to engage different sides or parts of the corresponding header ground shield. Optionally, the spring beams 182 may have respective different lengths such that the tips 186 are at different lengths from the base 174. For example, the center beam 188 extends farther from the base 174 (for example, is longer) than each of the side beams 190. Having different length spring beams 182 staggers the mating interfaces of the spring beams 182 with the header ground shields, which may reduce the mating force for mating the mezzanine receptacle connector 104 (shown in FIG. 1) with the mezzanine header connector 102.

The C-shields 140 also include compliant pins 192 that define the mounting ends 126. Like the compliant pins 162 (shown in FIG. 3) of the contact pair 150 (FIG. 3), the compliant pins 192 are configured to be terminated to the second circuit board 108 (shown in FIG. 1). The compliant pins 192 are eye-of-the-needle pins that may be received in plated vias in the circuit board 108 to mechanically and electrically couple the C-shields 140 to the circuit board 108. The compliant pins 192 may be received in the apertures 148 (shown in FIG. 2) of the pin organizer 146 (FIG. 2) to access the circuit board 108. Types of interfaces other than a compliant pin, such as a solder pin, a solder tail, a spring beam, and the like, may be provided at the mounting end 126 in alternative embodiments. Optionally, the C-shields 140 each include four compliant pins 192, with two extending from the center wall 176 and one extending from each of the side walls 178. Optionally, the compliant pins 192 extending from the center wall 176 are planar with the center wall 176, while the compliant pins 192 extending from the side walls 178 are each bent out of plane from the respective side wall 178. The side walls 178 each have a fixed end 196 attached to the center wall 176 and a free end 198 that is spaced apart from the center wall 176. In the illustrated embodiment, one of the compliant pins 192 of the C-shield 140 is disposed proximate to the fixed end 196 of one side wall 178, and another compliant pin 192 is disposed proximate to the free end 198 of the other side wall 178. Positioning the compliant pins 192 in the illustrated arrangement allows the C-shields 140 to be positioned side-by-side close together in the mezzanine receptacle connector 104 (shown in FIG. 1) and on the circuit board 108 to increase signal density.

Figure 5:
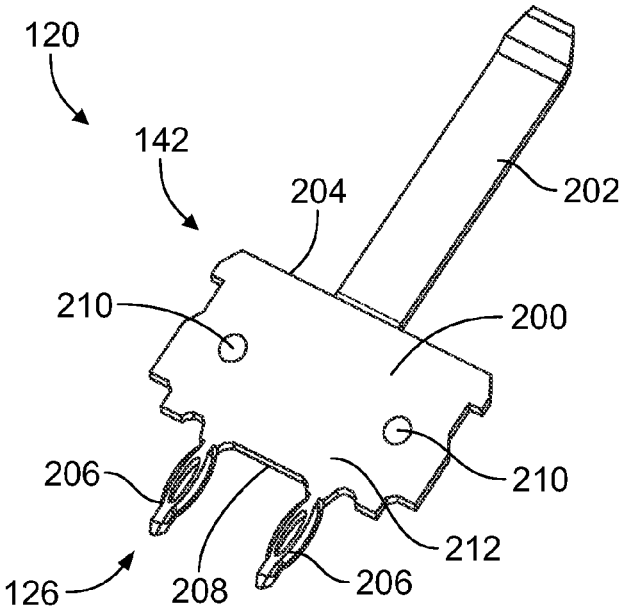
FIG. 5 is a perspective view of an orphan shield type of ground shield according to an embodiment.

With continued reference to FIGS. 4A and 4B, FIG. 5 is a perspective view of an orphan shield 142 type of ground shield 120 according to an embodiment. The orphan shield 142 includes a base 200 that is configured to be plugged into the housing 112 (shown in FIG. 2) and/or the ground frame 128 (FIG. 2) during assembly of the mezzanine receptacle connector 104 (FIG. 1). The base 200 is generally planar. The orphan shield 142 also includes a spring beam 202 extending from a top 204 of the base 200. The spring beam 202 is deflectable and is configured to interface with a corresponding header ground shield (not shown) of the mezzanine header connector 102 (shown in FIG. 1). The spring beam 202 may be shaped and formed similar to the center beam 188 of the C-shield 140. The orphan shield 142 further has at least one compliant pin 206 extending from a bottom 208 of the base 200 to the mounting end 126. Optionally, the orphan shields 142 each include two compliant pins 206. The compliant pins 206 may be eye-of-the-needle pins that are configured to be terminated to the second circuit board 108 (shown in FIG. 1).

In an embodiment, the base 174 of the C-shield 140 and the base 200 of the orphan shield 142 each include protrusions 210 extending therefrom. The protrusions 210 may be barbs, bumps, or the like. The protrusions 210 are configured to engage (for example, dig into) the housing 112 (shown in FIG. 2) and/or the ground frame 128 (FIG. 2) to hold the ground shields 120 in the housing 112 and/or the ground frame 128 by an interference fit. Optionally, the base 174 of the C-shield 140 includes at least one protrusion 210 on both the interior surface 170 and the exterior surface 172. Although the protrusions 210 are only shown on the center wall 176, the side walls 178 may include protrusions 210 in other embodiments. The orphan shield 142 may also include protrusions 210 on two opposing surfaces, although only one surface 212 is shown in FIG. 5.

In an embodiment, the C-shields 140 and the orphan shields 142 are configured to provide 360° electrical shielding around the perimeter of each contact pair 150 (shown in FIG. 3) of receptacle contacts 118 (FIG. 3). For example, the interior surface 170 of the C-shield 140 faces a corresponding contact pair 150 that the respective C-shield 140 at least partially surrounds. The walls 176, 178 of the base 174 and the spring beams 182 extend along three sides of the contact pair 150. Each contact pair 150 is surrounded on a fourth side by a C-shield 140 or by an orphan shield 142 in a next row 138 (shown in FIG. 2) of the housing 112 (FIG. 2). In an embodiment, the orphan shields 142 are disposed in a single row 138 of the auxiliary cavities 122B (shown in FIG. 2) along one of the sides 139 (FIG. 2) of the housing 112. The orphan shields 142 provide shielding for the contact pairs 150 in an adjacent or nearest row 138 along a side that is not shielded by the C-shields 140 in that row 138. In other rows 138, the side of the contact pairs 150 that is not shielded by the surrounding C-shield 140 is shielded by the center wall 176 of the C-shield 140 in an adjacent row 138. The ground shields 120 may also cooperate with the mating header ground shields to ensure that the contact pairs 150 are electrically shielded at the mating interfaces.

Figure 6A:
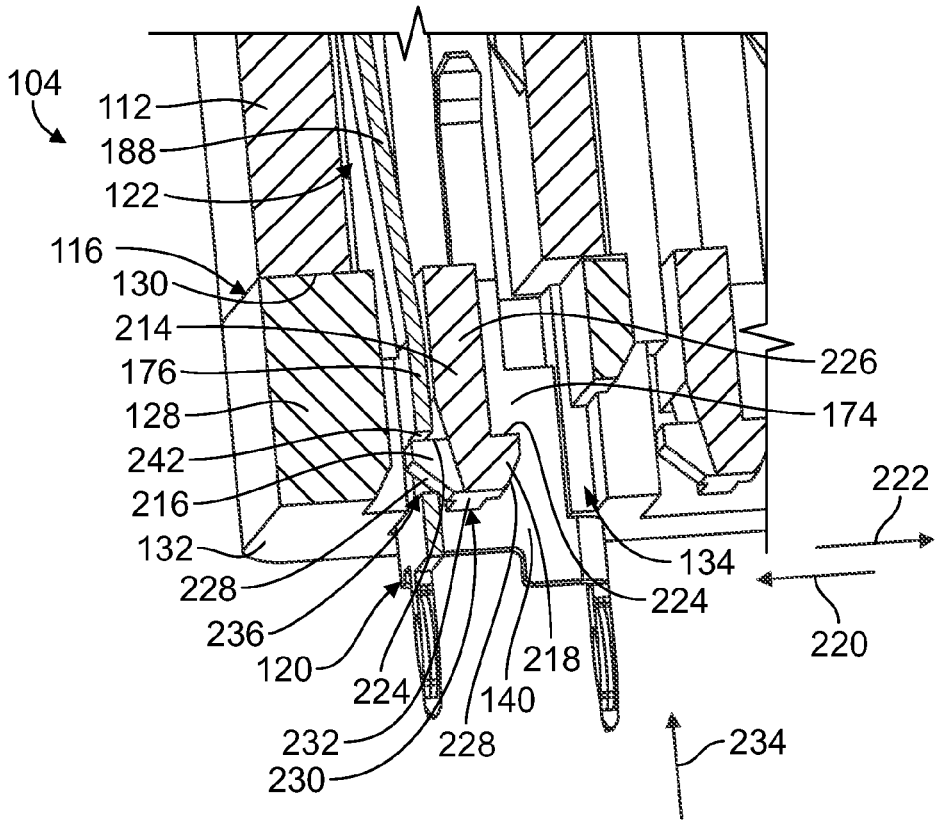
FIGS. 6A and 6B show a cross-section of a portion of the receptacle connector at various stages of loading a contact pair and a ground shield into a housing according to an embodiment.
Figure 6B:
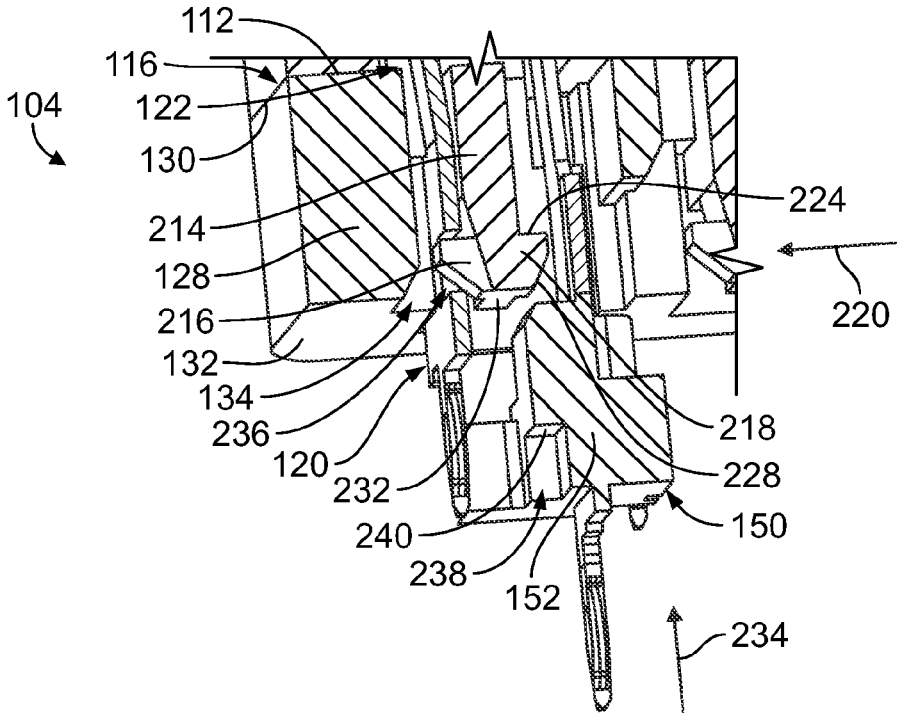

FIG. 6A is a cross-section of a portion of the mezzanine receptacle connector 104 according to an embodiment. In FIG. 6A, the C-shield 140 type of ground shield 120 (referred to herein as ground shield 120) is loaded in a corresponding cavity 122 of the housing 112, but the cavity 122 does not include a contact pair 150 (shown in FIG. 3) of receptacle contacts 118 (FIG. 3). FIG. 6B is a cross-section of a portion of the mezzanine receptacle connector 104 shown in FIG. 6A. In FIG. 6B, the contact pair 150 is partially loaded into the cavity 122 that includes the ground shield 120.

In an embodiment, the housing 112 includes retention latches 214 in at least some of the cavities 122. The retention latches 214 are configured to retain the ground shield 120 and the contact pair 150 within the housing 112. For example, the ground shields 120 and the contact pairs 150 engage the retention latches 214 as the ground shields 120 and contact pairs 150 are inserted into the cavities 122 during assembly of the mezzanine receptacle connector 104. In an embodiment, one retention latch 214 separately engages and retains both the ground shield 120 and the contact pair 150 in the same corresponding cavity 122. The retention latch 214 includes a first tab 216 configured to engage and retain the ground shield 120 and a second tab 218 configured to engage and retain the contact pair 150.

The retention latch 214 is located at the rear end 116 of the housing 112. In an embodiment, the retention latch 214 extends beyond the rear end 116 of the housing 112 and into one of the openings 134 of the ground frame 128. For example, the first and second tabs 216, 218 of the retention latch 214 are disposed within a thickness of the ground frame 128 between the first side 130 and the second side 132 of the ground frame 128. The first tab 216 and the second tab 218 each have a lug surface 224 facing towards the front end 114 (shown in FIG. 2) of the housing 112. The lug surface 224 extends at an angle from an arm 226 of the latch 214. For example, the lug surface 224 may be perpendicular to the arm 226. The first tab 216 and the second tab 218 each also have a ramp surface 228. The ramp surface 228 of each tab 216, 218 is located more proximate to a distal end 230 of the latch 214 than the respective lug surface 224. Optionally, the first and second tabs 216 may be disposed at the distal end 230 of the latch 214. The distal end 230 may include a generally planar butt 232 between the ramp surfaces 228 of the first and second tabs 216, 218.

The retention latch 214 is deflectable. In an embodiment, the retention latch 214 is configured to deflect relative to the housing 112 and the ground frame 128 in both a first direction 220 and an opposite, second direction 222 from an undeflected or unbiased position. For ease of description, the first direction 220 is referred to herein as a left direction 220, and the second direction 222 is referred to as a right direction 222. The retention latch 214 is located in the undeflected position when not biased by the ground shield 120 and/or the contact pair 150. The retention latch 214 deflects in the left direction 220 or the right direction 222 depending on the location, direction, and/or magnitude of the force applied to the retention latch 214.

The ground shield 120 is received in the corresponding cavity 122 along a first path. The first path is the space occupied by the ground shield 120 as the ground shield 120 is loaded into the cavity 122. The contact pair 150 is received in the corresponding cavity along a second path that is different from the first path. For example, the first path may be closer to the edges that define the cavity 122 than the second path, which may be closer to a radial center of the cavity 122. The first and second paths may extend through the opening 134 of the ground frame 128 and into the cavity 122 of the housing 112, since the ground frame 128 may be coupled to the rear end 116 of the housing 112. In an exemplary embodiment, the first tab 216 of the retention latch 214 is disposed in the first path when the retention latch 214 is undeflected. In addition, the second tab 218 is disposed in the second path when the retention latch 214 is undeflected. Thus, as the ground shield 120 is inserted into the cavity 122 in a loading direction 234 along the first path (and the latch 214 is in the undeflected position), the ground shield 120 engages the ramp surface 228 of the first tab 216. Similarly, as the contact pair 150 is inserted into the cavity 122 in the loading direction 234 along the second path (while the latch 214 is in the undeflected position), the contact pair 150 engages the ramp surface 228 of the second tab 218.

Referring to FIG. 6A, as the ground shield 120 is inserted into the opening 134 and the cavity 122, the center beam 188 and/or the center wall 176 of the base 174 engages the ramp surface 228 of the first tab 216, which forces the latch 214 to deflect in the right direction 222. As the latch 214 deflects in the right direction 222, the butt 232 of the latch 214 extends into the second path. The butt 232 disposed in the second path blocks the contact pair 150 (shown in FIG. 6B) from entering the opening 134 and/or the cavity 122 along the second path. Thus, the latch 214 prevents the contact pair 150 from being loaded into the cavity 122 at the same time that the ground shield 120 is being loaded into the cavity 122. The center wall 176 of the base 174 defines a slot 236 (shown also in FIG. 4B). As the ground shield 120 is loaded farther into the cavity 122, eventually the first tab 216 is received in the slot 236, which allows the biased latch 214 to return to the undeflected position. The ground shield 120 has reached a fully loaded position when the first tab 216 is received in the slot 236. As shown in FIG. 6A, the ground shield 120 is disposed in the fully loaded position, the first tab 216 is in the slot 236, and the latch 214 is in the undeflected position. The lug surface 224 of the first tab 216 is configured to engage an interior wall 242 of the slot 236 to retain the ground shield 120 within the cavity 122.

In FIG. 6B, the ground shield 120 is fully loaded within the cavity 122, and the contact pair 150 is being inserted in the loading direction 234 into the cavity 122 along the second path. The latch 214 is in the undeflected position, so the butt 232 of the latch 214 is not extending into the second path. As the contact pair 150 is inserted, the overmold body 152 engages the ramp surface 228 of the second tab 218, which forces the latch 214 to deflect in the left direction 220. The latch 214 is deflected closer to the ground shield 120. For example, the first tab 216 extends further into or through the slot 236 of the ground shield 120 than when the latch 214 is in the undeflected position. In addition, the butt 232 may extend at least partially into the slot 236. Thus, the butt 232 of the latch 214 extends into the first path when the latch 214 is deflected in the left direction 220 by the contact pair 150. Although the ground shield 120 is already loaded into the cavity 122 in FIG. 6B, if, alternatively, the contact pair 150 is being loaded into the cavity 122 prior to the ground shield 120, the butt 232 extending into the first path blocks the ground shield 120 from being received in the cavity 122 while the contact pair 150 is being loaded. The overmold body 152 defines a recess 238. As the contact pair 150 is loaded farther into the opening 134 and the cavity 122, eventually the second tab 218 is received in the recess 238, which allows the biased latch 214 to return to the undeflected position. The contact pair 150 is at the fully loaded position when the recess 238 receives the second tab 218 therein. The lug surface 224 of the second tab 218 is configured to engage an end wall 240 of the recess 238 to retain the contact pair 150 in the cavity 122.

Figure 7:
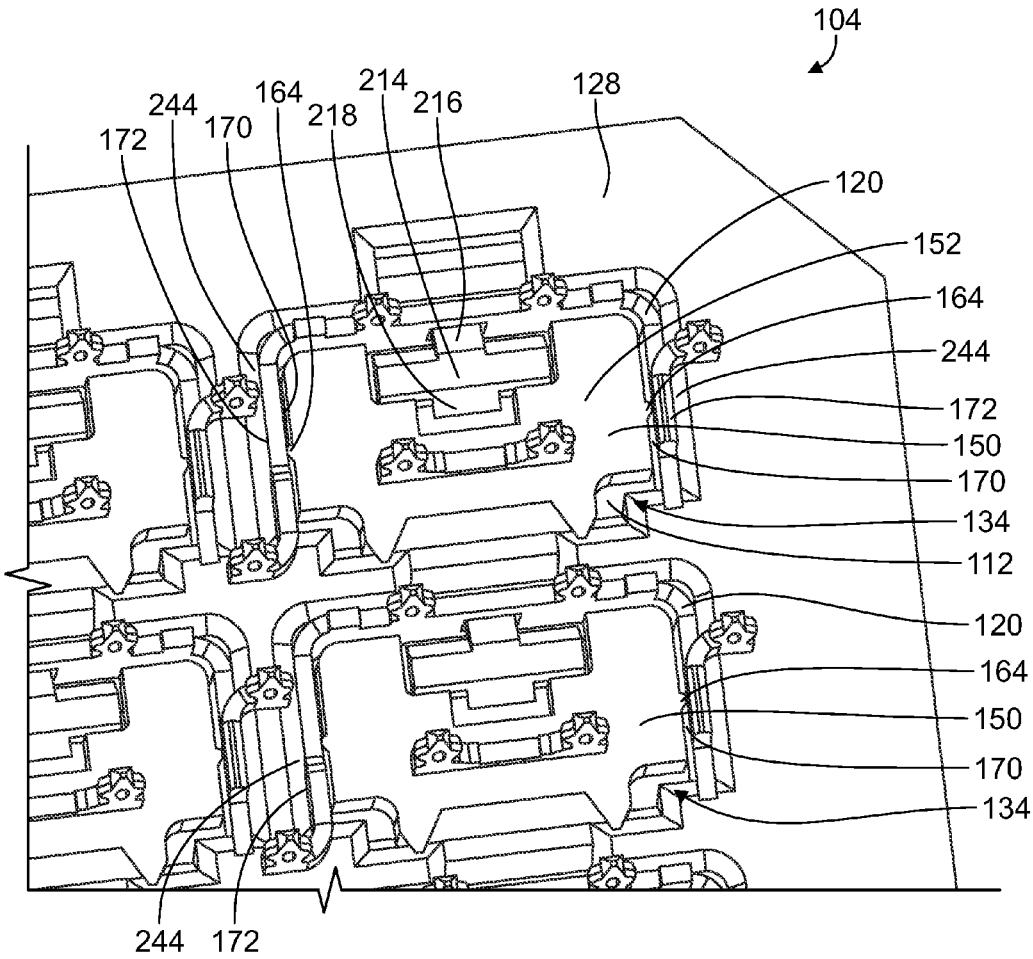
FIG. 7 is a rear view of a portion of the receptacle connector according to an embodiment.

FIG. 7 is a rear view of a portion of the mezzanine receptacle connector 104 according to an embodiment. The contact pairs 150 and the ground shields 120 are within the openings 134 of the ground frame 128 and the cavities 122 (shown in FIG. 2) of the housing 112. The contact pairs 150 are each retained by the second tab 218 of the corresponding retention latch 214. The ground shields 120 are each retained by the first tab 216 of the corresponding latch 214. In an exemplary embodiment, the ground shields 120 engage the ground frame 128 to electrically common the ground shields 120. For example, the exterior surface 172 of the ground shield 120 engages one or more interior walls 244 of the ground frame 128 that define the corresponding opening 134. Optionally, a perimeter of the opening 134 may be the same size or slightly smaller than a perimeter of the ground shield 120, such that the interior walls 244 apply a compressive force on the exterior surface 172 of the ground shield 120 to retain an electrical connection between the ground frame 128 and the ground shield 120. Optionally, the ribs 164 of the overmold body 152 of the contact pair 150 engage the interior surface 170 of the ground shield 120 and exert a force on the ground shield 120 outward against the interior walls 244 of the ground frame 128 to retain the electrical connection between the ground frame 128 and the ground shield 120.

FIG. 8 is an exploded view of the mezzanine receptacle connector 104 in accordance with an alternative embodiment. The mezzanine receptacle connector 104 has a housing 112, ground shields 120, receptacle contacts 118, a ground frame 128, and a pin organizer 146. Instead of a ground housing 144 (shown in FIG. 2), the ground frame 128 shown in FIG. 8 is a ground plate 250. The ground plate 250 is conductive. The ground plate 250 may be a stamped and formed panel or sheet of metal. The ground plate 250 may be thinner between the first side 130 and the second side 132 than the ground housing 144.

The ground plate 250 has openings 134 through which the terminating ends 124 of the contacts 118 and the mounting ends 126 of the ground shields 120 extend for termination to the second circuit board 108 (shown in FIG. 1). However, the contacts 118 and the ground shields 120 are not received through the openings 134 as the contacts 118 and the ground shields 120 are loaded into the cavities 122 of the housing 112. Instead, the contacts 118 and the ground shields 120 are loaded into the cavities 122 of the housing 112 prior to the ground plate 250 being coupled to the rear end 116 of the housing 112. The openings 134 of the ground plate 250 include signal openings 252 configured to receive the terminating ends 124 of the contacts 118. The openings 134 also include ground openings 254 configured to receive the mounting ends 126 of the ground shields 120. The signal openings 252 are sized and/or shaped differently than the ground openings 254. The signal openings 252 and the ground openings 254 of the ground plate 250 are each smaller than the openings 134 of the ground housing 144 (shown in FIG. 2).

Figure 9:
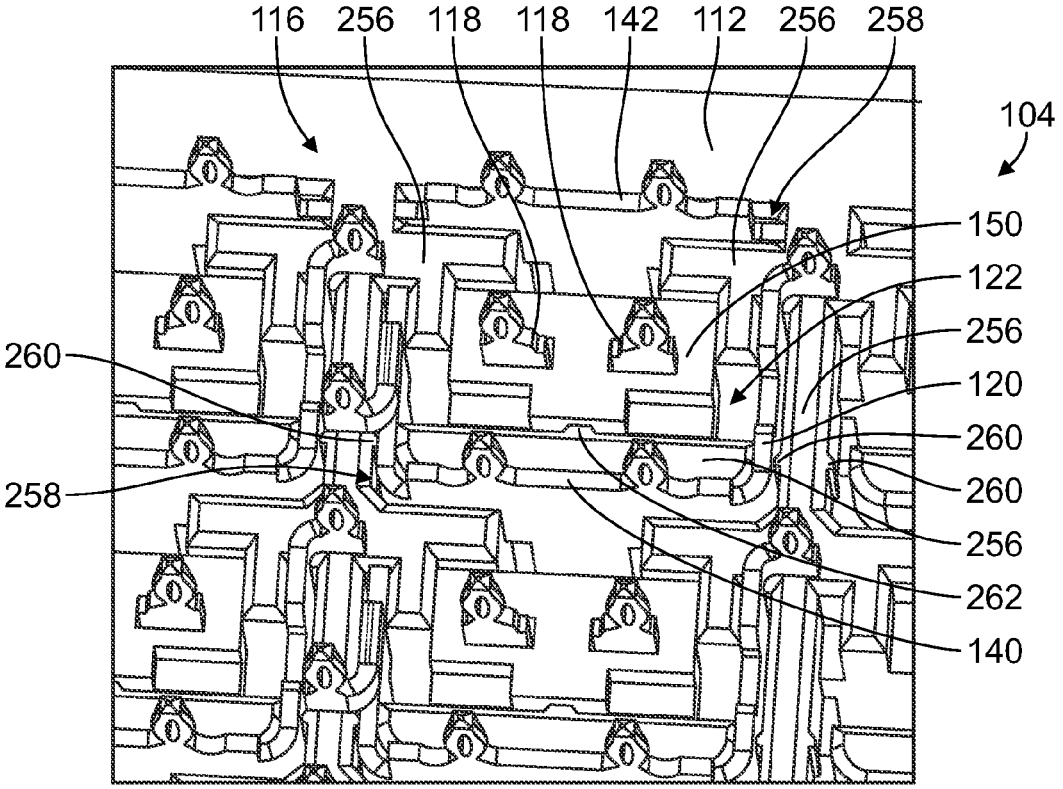
FIG. 9 is a rear perspective view of a portion of the receptacle connector shown in FIG. 8 with a ground plate removed.
Figure 10:
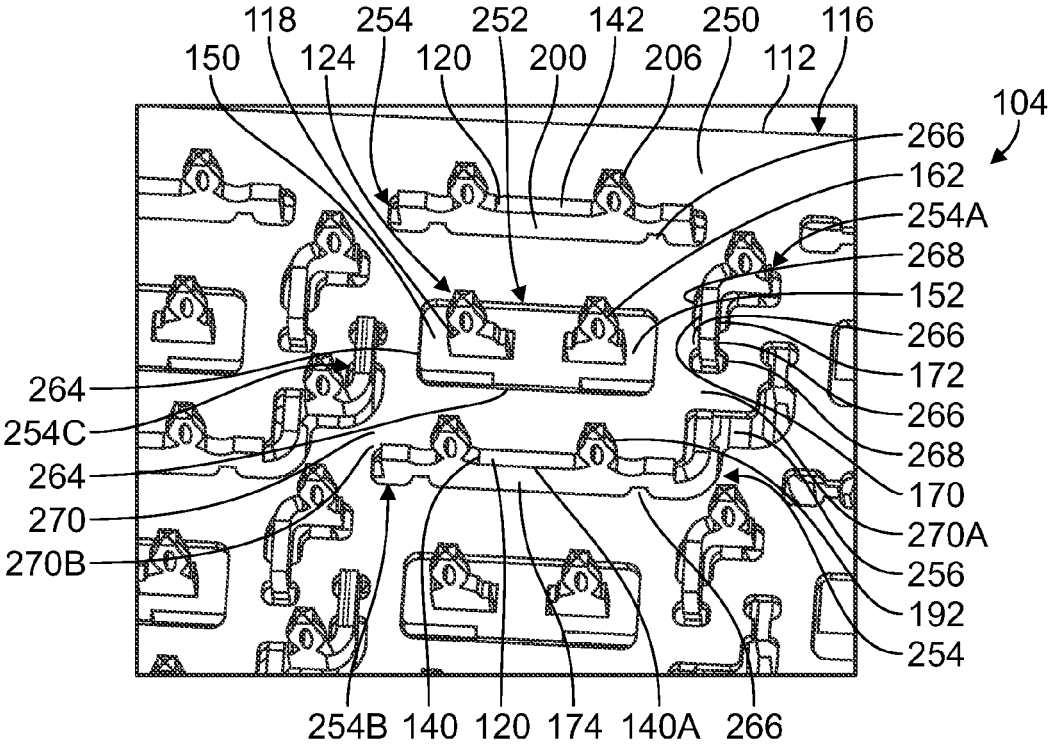
FIG. 10 is a rear perspective view of the portion of the receptacle connector shown in FIG. 9 with the ground plate present.

FIG. 9 is a rear perspective view of a portion of the mezzanine receptacle connector 104 shown in FIG. 8 prior to the ground plate 250 (shown in FIG. 8) being coupled to the housing 112. FIG. 10 is a rear perspective view of the portion of the mezzanine receptacle connector 104 shown in FIG. 8 having the ground plate 250 coupled to the housing 112. The rear end 116 of the housing 112 includes separating walls 256 that define the cavities 122. Some separating walls 256 extend between a corresponding contact pair 150 of receptacle contacts 118 and the ground shield 120 that surrounds that contact pair 150. Optionally, only the contact pairs 150 are received in the cavities 122, and the ground shields 120 (including the C-shields 140 and the orphan shields 142) are received in slots 258 surrounding the cavities 122. The separating walls 256 include ribs 260 that engage the ground shields 120 and protrusions 262 that engage the contact pairs 150. Although the protrusions 262 are shown as being wider than the ribs 260, in an alternative embodiment the ribs 260 and the protrusions 262 may have the same size and shape.

As shown in FIG. 10, when the ground plate 250 is coupled to the rear end 116 of the housing 112, the compliant pins 162 at the terminating ends 124 of the contact pairs 150 are received through the signal openings 252 of the ground plate 250. In addition, the compliant pins 192, 206 of the C-shields 140 and the orphan shields 142, respectively, are received through the ground openings 254 of the ground plate 250. The ground plate 250 covers at least most of the separating walls 256 of the housing 112. The signal openings 252 may have rectangular shapes that are sized to receive the compliant pins 162 of the contacts 118. The signal openings 252 may have some clearance between the compliant pins 162 and edges 264 of the signal openings 252. The edges 264 define the signal openings 252. For example, a portion of the overmold body 152, although not an entire cross-sectional area of the overmold body 152, is visible through the signal opening 252. The signal openings 252 are smaller than the cross-sectional area of the overmold bodies 152 such that the edges 264 of the signal openings 252 provide a wall that blocks the contact pairs 150 from exiting the cavities 122 (shown in FIG. 9) through the rear end 116 of the housing 112.

The ground openings 254 are configured to receive at least portions of the ground shields 120. For example, each ground opening 254 receives at least one compliant pin 192, 206 and a portion of the base 174, 200, respectively, from which the compliant pin(s) 192, 206 extends. The ground openings 254 have projections 266 that engage the ground shields 120 therein. For example, the projections 266 may engage the portions of the bases 174, 200 that extend through the ground openings 254. The projections 266 hold the ground shields 120 within the ground openings 254 by an interference fit. The projections 266 are also configured to retain an electrical connection between the ground shields 120 and the ground plate 250 to electrically common the ground shields 120. Optionally, the projections 266 may be on opposing edges 268 of the ground openings 254 to engage both the interior surface 170 and the exterior surface 172 of the ground shields 120. Optionally, the ground plate 250 may include dividing walls 270 that extend between the ground openings 254. Each dividing wall 270 extends across the base 174 of one of the C-shields 140. For example, in the illustrated embodiment, two dividing walls 270A, 270B extend across the same C-shield 140A, and, as a result, portions of the C-shield 140A extend through three different ground openings 254A, 254B, 254C. The dividing walls 270 of the ground plate 250 and/or the edges 268 of the ground openings 254 provide a wall that blocks the ground shields 120 from exiting the slots 258 (shown in FIG. 9) through the rear end 116 of the housing 112.

Although the embodiments described herein primarily describe the ground frames 128, 250 (shown in FIG. 2 and FIG. 8, respectively) as being associated with the receptacle connector 104 (shown in FIG. 1), it is recognized that the embodiments of the ground frame 128 may additionally or alternatively be used in association with the header connector 102 (FIG. 1). In addition, the ground frame 128, the retention latches 214 (shown in FIG. 6A), and other detailed components of the connectors are not limited to use in mezzanine style connectors, although mezzanine connectors constitute one exemplary use of such components described herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing extending between a front end and an opposite rear end, the front end configured to be mated with a mating connector;

receptacle contacts held by the housing, the receptacle contacts having terminating ends extending from the rear end of the housing for termination to a circuit board;

ground shields held by the housing, the ground shields each having a base extending between first and second ends, the base including at least one approximately planar wall at least partially surrounding the receptacle contacts to provide electrical shielding for the receptacle contacts, the ground shields each having at least one ground contact extending from the second end of the base, the ground contacts and rear portions of the bases of the ground shields extending from the rear end of the housing; and an electrically conductive ground frame having a first side coupled to the rear end of the housing and a second side facing the circuit board, the ground frame defining openings between the first side and the second side, the terminating ends of the receptacle contacts extending through the openings for termination to the circuit board, the rear portions of the bases of the ground shields positioned in the openings and the ground contacts extending through the openings for termination of the ground contacts to the circuit board, the ground frame engaging the rear portions of the bases of the ground shields that extend through the openings of the ground frame to electrically join the ground shields.

2. The electrical connector of claim 1, wherein the receptacle contacts include compliant pins at the terminating ends, the ground contacts including compliant pins, the electrical connector further comprising a pin organizer coupled to the second side of the ground frame, the pin organizer including a plurality of apertures that receive the compliant pins of both the receptacle contacts and the ground contacts to position the compliant pins relative to the circuit board for termination to the circuit board.

3. The electrical connector of claim 1, wherein the housing is an electrical insulator and the ground frame is an electrical conductor, the connector further comprising a pin organizer coupled to the second side of the ground frame, the pin organizer being an electrical insulator to electrically insulate the ground frame from the circuit board.

4. The electrical connector of claim 1, wherein the ground shields include C-shields and orphan shields, each C-shield extending along a corresponding pair of the receptacle contacts on three sides, each orphan shield extending along a corresponding pair of the receptacle contacts on one side.

5. The electrical connector of claim 1, wherein the receptacle contacts are organized in pairs carrying differential signals, each pair of the receptacle contacts is held in a non-conductive overmold body, the overmold body engaging a surrounding ground shield and electrically insulating the respective pair of the receptacle contacts from the surrounding ground shield.

6. The electrical connector of claim 5, wherein the overmold body includes ribs that force the surrounding ground shield outward against the ground frame.

7. The electrical connector of claim 1, wherein the ground shields are arranged in columns and rows, the ground frame engaging the ground shields disposed in different columns and in different rows to electrically join the ground shields of the different columns and the different rows.

8. The electrical connector of claim 1, wherein the ground frame is a stamped and formed plate, the openings of the ground frame including signal openings configured to receive the terminating ends of the receptacle contacts and ground openings configured to receive the ground contacts and rear portions of the bases of the ground shields.

9. The electrical connector of claim 8, wherein the base of each of the ground shields includes an exterior surface and an opposite, interior surface that faces the receptacle contacts that the respective ground shield at least partially surrounds, the ground openings of the ground frame having projections that engage the interior surface and the exterior surface of the rear portion of the base of the corresponding ground shields extending therethrough.

10. The electrical connector of claim 1, wherein the ground frame is at least one of a metal-plated plastic ground housing or a molded metal ground housing.

11. The electrical connector of claim 1, wherein the housing defines plural cavities that extend between the front end and the rear end, each cavity having a pair of the receptacle contacts and a ground shield loaded therein, the openings of the ground frame aligning with the cavities of the housing.

12. The electrical connector of claim 11, wherein the openings of the ground frame are smaller than the cavities of the housing, the ground frame configured to be coupled to the housing after the pairs of the receptacle contacts and the ground shields are loaded into the cavities of the housing, edges of the openings of the ground frame providing a wall that blocks the pairs of the receptacle contacts and the ground shields from exiting the cavities through the rear end of the housing.

13. The electrical connector of claim 1, wherein the housing defines plural cavities that extend between the front end and the rear end, each cavity having a pair of the receptacle contacts and a ground shield loaded therein, the housing including deflectable retention latches within the cavities, each retention latch having a first tab configured to retain the ground shield in the respective cavity and a second tab configured to retain the pair of the receptacle contacts in the cavity.

14. The electrical connector of claim 13, wherein the cavities of the housing each receive the ground shield along a first path and receive the pair of the receptacle contacts along a different, second path, the first tab of the retention latch being disposed in the first path when the retention latch is undeflected, wherein, as the ground shield is received in the cavity, the ground shield engages a ramp surface of the first tab and the retention latch is deflected into the second path until the first tab is received in a slot of the ground shield, the retention latch blocking the pair of the receptacle contacts from being received in the cavity while the retention latch is deflected into the second path.

15. The electrical connector of claim 14, wherein the second tab of the retention latch is disposed in the second path when the retention latch is undeflected and, as the pair of the receptacle contacts is received in the cavity, the pair engages a ramp surface of the second tab and the retention latch is deflected into the first path until the second tab is received in a recess of the pair, the retention latch blocking the ground shield from being received in the cavity while the retention latch is deflected into the first path.

16. The electrical connector of claim 13, wherein the retention latches extend beyond the rear end of the housing, the first and second tabs of each retention latch disposed between the first and second sides of the ground frame in a corresponding one of the openings of the ground frame.

17. An electrical connector comprising:

a housing extending between a front end and an opposite rear end, the front end configured to be mated with a mating connector, the housing defining plural cavities that extend between the front end and the rear end, the housing including deflectable retention latches within the cavities;

a ground frame having a first side coupled to the rear end of the housing and a second side facing a circuit board;

receptacle contacts held by the housing, the receptacle contacts having terminating ends extending from the rear end of the housing through the ground frame for termination to the circuit board, the receptacle contacts organized in plural contact pairs, each contact pair disposed in one of the cavities of the housing; and ground shields held by the housing, each ground shield disposed in a corresponding one of the cavities and at least partially surrounding one of the contact pairs to provide electrical shielding between said contact pair and nearby contact pairs, the ground shields having mounting ends extending from the rear end of the housing through the ground frame for termination to the circuit board, the ground shields engaging the ground frame to electrically join the ground shields;

wherein each retention latch has a first tab configured to retain the ground shield in the respective cavity and a second tab configured to retain the contact pair in the respective cavity.

18. The electrical connector of claim 17, wherein the housing is an electrical insulator and the ground frame is an electrical conductor, the connector further comprising a pin organizer coupled to the second side of the ground frame, the pin organizer being an electrical insulator to electrically insulate the ground frame from the circuit board.

19. The electrical connector of claim 17, wherein the cavities of the housing each receive the ground shield along a first path and receive the contact pair of the receptacle contacts along a different, second path, the first tab of the retention latch being disposed in the first path when the retention latch is undeflected, wherein, as the ground shield is received in the cavity, the ground shield engages a ramp surface of the first tab and the retention latch is deflected into the second path until the ground shield reaches a fully loaded position, the retention latch blocking the contact pair from being received in the cavity while the retention latch is deflected into the second path.

20. The electrical connector of claim 19, wherein the second tab of the retention latch is disposed in the second path when the retention latch is undeflected and, as the contact pair of the receptacle contacts is received in the cavity, the contact pair engages a ramp surface of the second tab and the retention latch is deflected into the first path until the contact pair reaches a fully loaded position, the retention latch blocking the ground shield from being received in the cavity while the retention latch is deflected into the first path.

* * * * *